US011326503B2

(12) United States Patent
Callahan

(10) Patent No.: US 11,326,503 B2
(45) Date of Patent: May 10, 2022

(54) PORTABLE EXHAUST REMOVAL SYSTEM

(71) Applicant: John P Callahan, Worcester, MA (US)

(72) Inventor: John P Callahan, Worcester, MA (US)

( * ) Notice: Subject to any disclaimer, the term of this patent is extended or adjusted under 35 U.S.C. 154(b) by 0 days.

(21) Appl. No.: 16/745,271

(22) Filed: Jan. 16, 2020

(65) Prior Publication Data

US 2020/0224579 A1 Jul. 16, 2020

Related U.S. Application Data

(60) Provisional application No. 62/793,037, filed on Jan. 16, 2019.

(51) Int. Cl.
*F01N 13/18* (2010.01)
*F01N 13/08* (2010.01)

(52) U.S. Cl.
CPC ..... *F01N 13/1805* (2013.01); *F01N 13/082* (2013.01); *F01N 13/1844* (2013.01)

(58) Field of Classification Search
CPC combination set(s) only.
See application file for complete search history.

(56) References Cited

U.S. PATENT DOCUMENTS 5,092,228 A * 3/1992 Pfeiffer, Jr. ..... B08B 15/00 104/52
5,428,957 A * 7/1995 Keates ..... F01N 13/00 251/147
5,518,447 A * 5/1996 Nordin ..... F16L 3/015 454/63
5,542,250 A * 8/1996 Ball ..... B08B 15/002 454/63
5,630,751 A * 5/1997 Hansen ..... B08B 15/005 454/64
5,911,623 A * 6/1999 Trana ..... B08B 15/002 138/89
6,306,031 B1 * 10/2001 Hansen ..... B08B 15/002 454/63
7,213,847 B2 * 5/2007 Umiastowski ..... F01N 13/082 285/235
7,273,413 B2 * 9/2007 Frink ..... B08B 15/002 285/62
9,719,680 B2 * 8/2017 Staller ..... F23J 11/08
10,669,917 B1 * 6/2020 Atwell ..... F01N 13/08
2011/0265449 A1 * 11/2011 Powell ..... F23J 11/00 60/272

* cited by examiner

*Primary Examiner* — Binh Q Tran
(74) *Attorney, Agent, or Firm* — Polsinelli, P.C.

(57) ABSTRACT

A portable, easily mountable, temporary exhaust removal system adapted to re-direct exhaust emissions away from an internal combustion engine having an exhaust conduit that exhausts combustion gas from the engine.

1 Claim, 2 Drawing Sheets

PORTABLE EXHAUST REMOVAL SYSTEM

CROSS-REFERENCE TO RELATED APPLICATIONS

This application claims the benefit under 35 U.S.C. § 119(e) of U.S. Provisional Application No. 62/793,037 filed Jan. 16, 2019, which is hereby incorporated by reference.

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

The present invention pertains to means to protect firefighters and other persons who similarly may find themselves in proximity to hazardous exhaust emissions while performing their job. Such exhaust emissions generated by a vehicle or other device powered by an internal combustion engine.

Diesel engines, used in fire trucks, produce a mixture of toxic gases and particulates from the combustion process. These hazardous vehicle exhaust emissions in a fire station are one of a firefighter's most significant cancer health risks and a serious legal liability for the fire department. It is essential to create healthy and safe working conditions by reducing these risks. Protective measures are an important aspect of this.

It is nearly universal equipment for fire stations to have installed a system for venting exhaust fumes generated by fire trucks idling inside the enclosed garage area of those stations. One example of such an exhaust removal system is the PLYMOVENT system manufactured by Plymovent Corporation. Although there are occasional differences in design most fire departments across the nation are equipped with a similar system which removes exhaust fumes from the fire station.

When a fire truck returns from a call, and is idling in the fire station the exhaust removal system vent is connected to the exhaust outlet of the truck. The system kicks on and the exhaust fumes are sucked from the muffler of the truck through the pipes and sent out a chimney from the station. This device prevents the known carcinogens in diesel fuel fumes from entering the living and working space of the crew of firefighters.

Prior systems, such as the Plymovent system, used for venting exhaust gases are characterized by a lack of mobility and are useful only at the site at which they are permanently installed. Also, these venting systems necessitate an extensive and expensive ducting system including mechanical means for pulling exhaust gases through the venting system in order to remove these exhaust gases from the installed space. This type of exhaust removal system often takes care of the need for protecting firefighters by removing exhaust emissions from the fire station garage area but is not used in the field.

However, there is also a need for limiting a firefighter's exposure to toxic diesel fumes extending beyond the firehouse to the fire ground at a fire incident. At a fire incident, any number of situations may arise in which firefighters are in direct contact with the diesel fumes generated by idling fire trucks in use at the fire ground. There is no current means to redirect the diesel fumes away from firefighters in this common situation. A similar situation exists, during fire fighter training exercises, where the use of idling fire trucks may be part of the training exercises.

These and other difficulties experienced with the prior art devices have been obviated in a novel manner by the present invention.

It is therefore, an outstanding object of some embodiments of the present invention to provide a system that protects firefighters from hazardous vehicle exhaust emissions by removing and re-directing those exhaust gases away from firefighters but without the extensive cost of currently available venting systems.

Another object of some embodiments of the present invention is to provide a system that protects firefighters from hazardous vehicle exhaust emissions by removing and re-directing those exhaust gases away from firefighters but without the necessity of permanently installed equipment as with currently available venting systems.

A further object of some embodiments of the present invention is to provide a system that protects firefighters from hazardous vehicle exhaust emissions by removing and re-directing those exhaust gases away from firefighters while at a fire incident, or any time the firefighters are working proximate to an idling fire truck parked in the open air and away from the fire station's exhaust removal system.

Still another object of some embodiments of the present invention is to provide a system for re-directing exhaust fumes while a fire truck is idling outside in a manner that is based on a simple design and easy for fire fighting personnel to use.

A further object of some embodiments of present invention is to provide a system for removal and re-directing exhaust fumes that can be stored on a fire truck and readily installed by firefighters at a fire incident.

With these and other objects in view, as will be apparent to those skilled in the art, the invention resides in the combination of parts set forth in the specification and covered by the claims appended hereto, it being understood that changes in the precise embodiment of the invention herein disclosed may be made within the scope of what is claimed without departing from the spirit of the invention.

BRIEF SUMMARY OF THE INVENTION

The present invention is an exhaust redirecter which connects the exhaust pipe conduit of a fire truck or any motor vehicle having an exhaust system, to an elongated chimney stack and provides a means for redirecting toxic exhaust gases away from persons who may be in the vicinity of the exhaust conduit. The present invention uses known connecting means, for example such as is used in a PLYMOVENT system, to provide a well sealed and secure connection between the exhaust pipe conduit and an elongated vertical chimney stack. The connection is not only securely attached but is also readily removable by firefighters when no longer needed. The connection can be any similar secure means of connecting the exhaust pipe to re-direct the toxic gases.

The present invention provides a simple design and cost effective means of protection to firefighters. It does not require any extensive powered ventilation system in order to provide this protection. The present invention can be used in an enclosed area effectively if there is installed, near the ceiling of the area, a means to vent air to the outside and away from the enclosed space. However, the present invention is portable and can be used in the field at fire incidents or training sessions away from the fire station garage and in locations that do not have access to a PLYMOVENT type ventilation system. It is easily stored on a fire truck and is easily installed by firefighters when needed.

BRIEF DESCRIPTION OF THE SEVERAL VIEWS OF THE DRAWINGS

The character of the invention, however, may best be understood by reference to one of its structural forms, as illustrated by the accompanying drawings, in which.

DETAILED DESCRIPTION OF THE INVENTION

Figure 1:
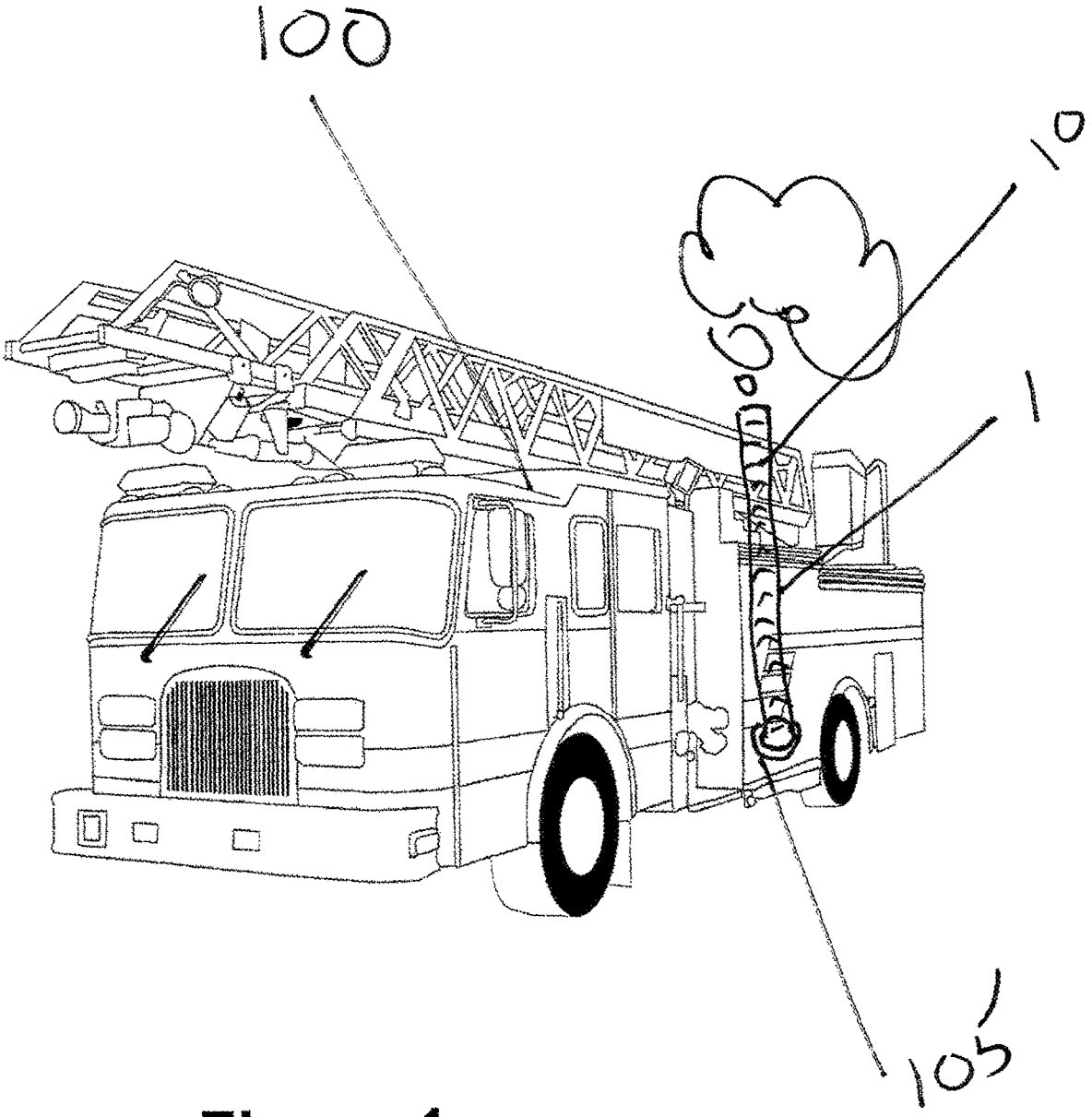
FIG. 1 shows a fire truck having an exhaust pipe which emits diesel fumes when the truck's engine is in operation. The portable exhaust removal system, the present invention, is shown in use, securely connected to the exhaust pipe of the fire truck.

Referring first to FIG. 1, in which the general principles of the present invention are shown. Figure one shows a typical fire truck (100) with a portable exhaust removal system (1) connected to the exhaust pipe (105). The exhaust emissions, propelled by the force of the fire truck's internal combustion engine, are re-directed upward, through the elongated chimney stack (10), the stack being of sufficient length to discharge the exhaust gases over and away from a firefighter. The exhaust emissions are released appreciably overhead rather than settling around firefighters who may be working near the fire truck's exhaust pipe.

Figure 2:
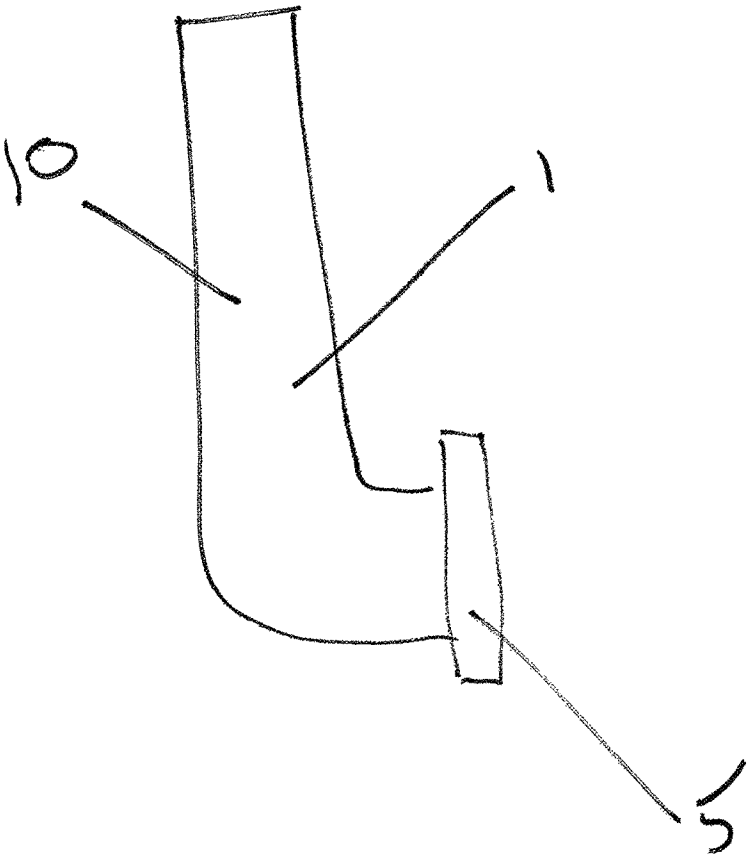
FIG. 2 shows a side view of the portable exhaust removal system and its main components, a chimney stack and a means of connecting the exhaust removal system to the fire truck's exhaust pipe.

Referring next to FIG. 2, in which an embodiment of the portable exhaust removal system (1) is shown in closeup. This side view of the portable exhaust removal system (1) shows clearly the main components of the system. This includes an elongated chimney stack (10) consisting of a tube of such length as to make the upper opening of the portable exhaust removal system (1) appreciably above the head of a typical firefighter. Thereby, directing the exhaust emissions into the upper air and away from firefighters on the ground. Also shown is a connector means (5) that allows for ease of attachment and removal of the portable exhaust removal system (1) from the exhaust pipe of the fire truck. The connector means is any which provides secure connection to the fire truck's exhaust pipe and which creates enough of a seal around the exhaust pipe in order to prevent leaking of the exhaust emissions at that point. Such types of connectors are well known in the art.

Figure 3:
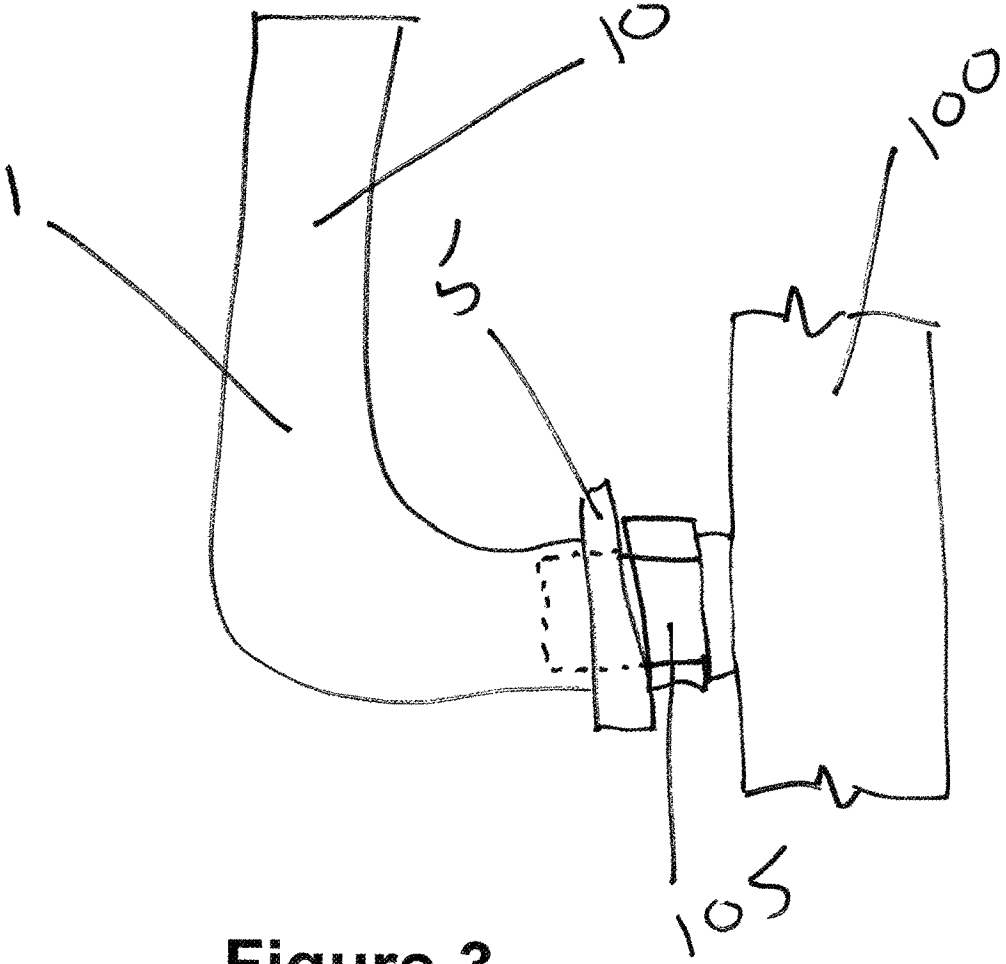
FIG. 3 shows a side view of the portable exhaust removal system in use, securely connected to the exhaust pipe of the fire truck.

Referring finally to FIG. 3, in which is shown a side view of the portable exhaust removal system (1) in use, securely connected to the exhaust pipe (105) of the fire truck (100). The connector means (5) fits securely around the exhaust pipe (105) of the fire truck (100) and provides a tight seal so that no exhaust emissions leak out into the air from around the exhaust connector (5) interface with the exhaust pipe.

The configuration shown in FIG. 3, is one embodiment of the present invention. The portable exhaust removal system as installed would protect firefighters from hazardous vehicle emissions and the toxic fumes generated by the internal combustion engine of the fire truck.

One embodiment of the present invention uses the bottom elbow portion of a system similar to a PLYMOVENT analogous system. A length of flexible hose is coupled together to the exhaust pipe acting as a portable elongated chimney stack, while redirecting volatile air away from the immediate area and thereby improving the quality of air in the vicinity of the exhaust pipe of the fire truck. In a further embodiment, the connection to the vertical elongated chimney stack can be similar to the bottom elbow portion of the PLYMOVENT system. With a 4 inch piece of flexible pipe coupled together the pipe acts as a portable chimney stack to redirect volatile air and thereby improving the quality of the air when necessary.

The present invention can easily be made shorter or longer depending on the particular needs of the users. Some embodiments may be considered bulky but would not need to be much heavier than many of the other tools that firefighters bring to a fire incident to provide efficient fire fighting service. Making the chimney stack too small in order for it to be made easier to handle might inhibit the ability for the exhaust fumes to be released out the chimney stack upper opening.

Although, this device might not be used during every fire incident or training exercise, it would go a long way in preventing the unseen enemy of firefighters which is linked to cancer. Any device in a firefighters tool box that helps protect the firefighter from these toxic and possibly carcinogenic exhaust gases will help improve the firefighters health and safety.

It is obvious that minor changes may be made in the form and construction of the invention without departing from the material spirit thereof. It is not desired to confine the invention to the exact form herein shown and described, but it is desired to include all such as properly come within the scope claimed.

The invention having been thus described, what is claimed as new and desired to secure by Letters Patent is:

1. A method for reducing the toxic exhaust gases to which firefighters, working outdoors and adjacent a running firetruck, having an internal combustion engine and a body, are exposed, said firetruck having an engine exhaust pipe with a first, outboard opening adjacent the lower peripheral edge of the truck, the method employing a closed conduit having a first, inboard end and a second, outboard end, comprising the steps of:

(a) attaching the inboard end of a closed conduit to the first end of the exhaust pipe so as to capture the exhaust gases from the exhaust pipe into the conduit, (b) locating the second, outboard end of the conduit to a position above the top of the firetruck body so as to exhaust the exhaust gases to a point above the top of the firetruck, and (a) operating the firetruck, with its motor running and producing exhaust gas in the exhaust pipe, outdoors and in the presence of firefighters outside the firetruck, wherein the conduit is temporarily attached to the top of the firetruck body, at least while the motor is running and the firetruck is outdoors and fighting a fire, while the outboard end of the conduit is positioned above the top of the firetruck body in order to exhaust the exhaust gases above the top of the firetruck, at least while the motor is running and the firetruck is outdoors and fighting a fire, for reducing the toxic gases to which firefighters, working outdoors and adjacent a running firetruck, are exposed.

* * * * *